United States Patent [19]

Benson

[11] 4,446,698

[45] May 8, 1984

[54] ISOTHERMALIZER SYSTEM

[75] Inventor: Glendon M. Benson, Danville, Calif.

[73] Assignee: New Process Industries, Inc., Minneapolis, Minn.

[21] Appl. No.: 244,941

[22] Filed: Mar. 18, 1981

[51] Int. Cl.[3] ..... F02G 1/04

[52] U.S. Cl. ..... 60/520; 60/517; 60/526; 62/6

[58] Field of Search ..... 60/517, 520, 526, 508, 60/509, 512; 62/6; 92/42, 45; 417/367, 472

[56] References Cited

U.S. PATENT DOCUMENTS

| | | | |
|---|---|---|---|
| 3,484,616 | 12/1969 | Baumgardner et al. | 60/520 X |
| 3,513,659 | 5/1970 | Martini | 417/383 |
| 3,583,155 | 6/1971 | Schuman | 60/520 |
| 3,604,821 | 9/1971 | Martini | 60/526 X |
| 4,188,791 | 2/1980 | Mulder | 60/520 |
| 4,199,945 | 4/1980 | Finkelstein | 60/520 |
| 4,215,548 | 5/1980 | Beremand | 60/520 |
| 4,361,008 | 11/1982 | Dineen | 60/520 X |

FOREIGN PATENT DOCUMENTS 126969 5/1947 Australia .

*Primary Examiner*—Allen M. Ostrager
*Assistant Examiner*—Stephen F. Husar
*Attorney, Agent, or Firm*—Townsend and Townsend

[57] ABSTRACT

A construction of a variable volume chamber that allows cycling of a working fluid to occur substantially isothermally is disclosed. The present invention provides a fixed, rigid heat conductive element within the chamber. The heat conductive element has a surface area which is large relative to that of the chamber itself. The volume of the chamber is varied by a mechanism which meshes with the heat conductive element to minimize dead volume. As a result the heat conductive element absorbs and returns heat energy to and from the working fluid in an efficient fashion, resulting in a high degree of isothermalization of the working fluid.

29 Claims, 12 Drawing Figures

ISOTHERMALIZER SYSTEM

The present invention relates to fluid devices wherein a working fluid is contained in a variable volume chamber and subjected to a thermodynamic cycle. More specifically, the invention relates to a construction of the variable volume chamber that provides a high degree of isothermalization.

BACKGROUND OF THE INVENTION

The maximum efficiency of a heat engine, given by the Carnot efficiency, can only be achieved if expansion and compression of a working fluid in a variable volume chamber are carried out as nearly isothermally (i.e., at a constant temperature) as possible. The desirability of isothermal expansion and compression is also manifest in a heat pump cycle where it is desired to achieve a coefficient of performance that approaches the Carnot limit. Similarly, a gas compressor can be operated with a minimum amount of work if the compression is carried out isothermally. However, where the volume of working fluid is large, or when the cycle frequency is high, the ideal condition of isothermal expansion and compression is difficult to achieve.

In the past, it has been a practice to use external heat exchangers through which the working fluid is flowed during its expansion and compression. However, external heat exchangers are complex devices which add to the expense and size of the machines. Furthermore, a dead volume is inherent in the use of such external heat exchangers, requiring a larger displacement for a given capacity and pressure ratio. Moreover, the external heat exchangers are sources of axial (thermal shunt) losses due to their cross section.

Isothermalizing of work chambers has always been the goal in the development of highly efficient heat engines such as those employing a Stirling or Ericsson engine. Apparently, some sort of isothermalizing system is employed in the early development of such engines, as indicated in "Napier and Rankine's patent Hot-Air Engines," *Mechanics Magazine,* No. 1628, Oct. 21, 1854. A patent to Dineen, U.S. Pat. No. 3,220,178, suggests the use of a flexible cloth. In a paper in the Intersociety Energy Conversion Engineering Conference proceedings, Aug. 20, 1973, page 198, entitled "Thermal Losses In Gas-Charged Hydraulic Accumulators" by David R. Otis, the use of a flexible polyurethane foam is suggested. In all these systems, apparently the object was to utilize a flexible material which changed its size and shape in accordance with chamber volume. However, such systems have proved to be very inefficient in actually achieving isothermalization, and the use of heat exchangers is still necessary.

SUMMARY OF THE INVENTION

The present invention provides a construction of a variable volume chamber that allows cycling of a working fluid to occur substantially isothermally, without the need for external heat exchangers. This results in smaller, simpler, cheaper, and more effective fluid devices.

Rather than the flexible thermal elements found in the prior art, the present invention provides a fixed, rigid heat conductive element within the chamber. The heat conductive element has a surface area which is large relative to that of the chamber itself. The volume of the chamber is varied by a mechanism which meshes with the heat conductive element to minimize dead volume. As a result the heat conductive element absorbs and returns heat energy to and from the working fluid in an efficient fashion, resulting in a high degree of isothermalization of the working fluid.

According to one aspect of the invention, a variable volume chamber is provided with a cylinder head having a plurality of thin closely spaced concentric rings. In applications where a solid piston is used, the piston crown includes a second corresponding and cooperating plurality of rings. The cylinder head rings and the piston crown rings are sized so that the two pluralities nest and mesh with each other during operation, with the depth of engagement at least equal to the stroke. The gap between a given piston ring and its radially adjacent cylinder head rings is maintained at as small a dimension as possible without having the rings contact. The working fluid thus occupies annular regions that are staggered radially, with radially adjacent regions offset axially.

The primary method of heat transfer from the working fluid is conduction to the cylinder head rings. With solid rings, the heat must be conducted axially along the rings. For long-stroke or high power density applications where the axial conduction of the cylinder head rings is a limitation, the cylinder rings are preferably hollow with a flow of heat transfer fluid established within.

According to another aspect of the invention, a liquid piston is used with an open reticulated material as described in U.S. Pat. No. 3,946,039, a honeycomb core material, or other type of porous heat conductive rigid material which fills the entire variable volume chamber. As the liquid piston moves to vary the volume of the chamber, it occupies to a greater or lesser degree the pores in the heat conductive material. As a result, the working fluid is compressed or expanded in a nearly isothermal fashion because the heat conductive porous material absorbs and returns heat energy.

In certain applications, the heat conductive material itself has sufficient thermal mass to provide effective isothermalization. In other situations, the heat conductive material can be attached to a sidewall of the chamber which is constructed of material having substantial thermal capacity, which can serve as a heat reservoir. Also, particularly in the situation in which hollow rings and a heat transfer fluid are used, heat energy may be transferred to and from a heat reservoir remote from the chamber.

Alternately, in the case of a liquid piston for varying the volume of the working fluid, the liquid may be directed to flow over the heat exchanging matrix surface and in so doing act as a virtual thermal mass for assisting in the isothermalization of the working fluid contained within the open matrix structure.

An alternate configuration provides for convective heat transfer under circumstances where the amount of heat that must be transferred to maintain an isothermal condition exceeds the amount that can be transferred by conduction alone. According to this aspect of the invention where a working fluid flows in and out of the variable volume chamber, the fluid may be caused to flow radially along a tortuous path. Thus, for example, in an air compressor, the cylinder head may have its valves located to establish flow into the radially outermost annular region so that upon compression and discharge, fluid flows radially outwardly through the conductive material.

A further understanding of the nature and advantages of the invention, reference should be had to the ensuing detailed description taken in conjunction with the accompanying drawings.

DESCRIPTION OF THE PREFERRED EMBODIMENTS

Figure 1:
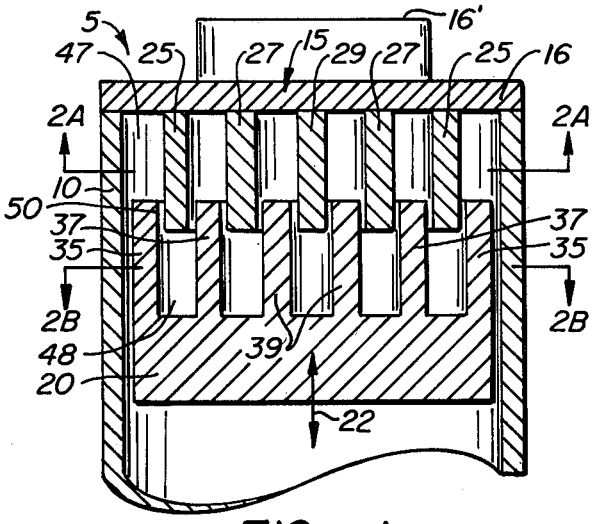
FIG. 1 is a sectional view of a piston and cylinder head taken through a plane including the cylinder axis.
Figure 2A:
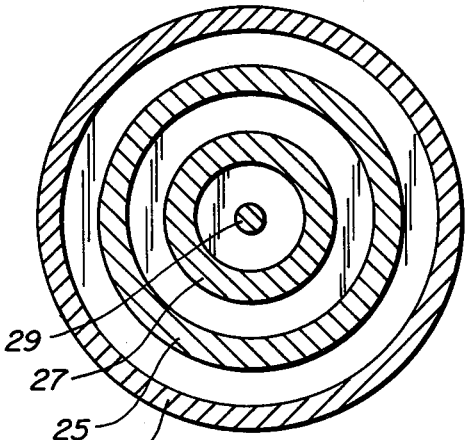
FIG. 2*a* is a sectional view of the cylinder head taken along line 2*a*—2*a* of FIG. 1.
Figure 2B:
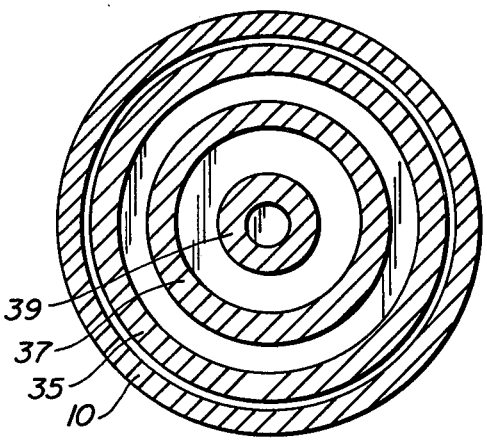
FIG. 2*b* is a sectional view of the piston taken along line 2*b*—2*b* of FIG. 1.

Referring to FIGS. 1 and 2*a* and 2*b*, the basic construction of one embodiment of the invention can be seen. A variable volume chamber containing a compressible working fluid is defined by a cylinder 5 having a cylindrical outer wall 10 and a head 15, and a piston 20 moveable along the axis of cylinder 5 as indicated by double headed arrow 22. Cylinder head 15 is fitted with a plurality of thin concentric rings 25, 27, and 29 (hereinafter designated head rings) of heat conductive material. Moveable piston crown 20 is fitted with a plurality of concentric rings 35, 37 and 39 (hereinafter designated crown rings). Head rings 25–29 and crown rings 35–39 are sized and spaced such that the head rings fit in the spaces between adjacent piston rings, and the piston rings fit in the spaces between adjacent head rings so that the piston rings mesh with the cylinder rings. The rings are of an axial dimension sufficiently large that they maintain the meshing relationship over the complete stroke of piston 20, and when the piston is fully extended, the volume remaining in the chamber (dead volume) is minimized.

The head rings 25–29 and the crown rings 35–39 cooperate to define a first plurality of annular regions 47 proximate head 15 and a second plurality of annular regions 48 proximate piston 20 and a plurality of gaps 50 between the rings. Annular regions 47 and annular regions 48 are in a staggered and offset relationship. Each annular region 47 communicates with radially adjacent (but axially offset) annular regions 48 via annular gaps 50. Gaps 50 are sized at as small a radial dimension as is practical for avoiding contact between crown rings and radially adjacent head rings, generally no more than about 0.1 mm.

Head rings 25–29 of FIGS. 1 and 2*a* are solid and may provide suitable isothermalization for short-stroke, low-power density applications. The head rings 25–29 themselves may have sufficient thermal mass in providing adequate storage of heat energy, and the rings may be thermally isolated from any substance but the working fluid. If a higher thermal mass is desirable for additional heat capacity, the side wall of the chamber to which the heat conductive head rings 25–29 are connected can be constructed of a heat conductive material to provide additional heat storage. Further thermal mass can be provided in the form of a reservoir 16' thermally coupled to sidewall 16 or directly to head rings 25–29.

Figure 3:
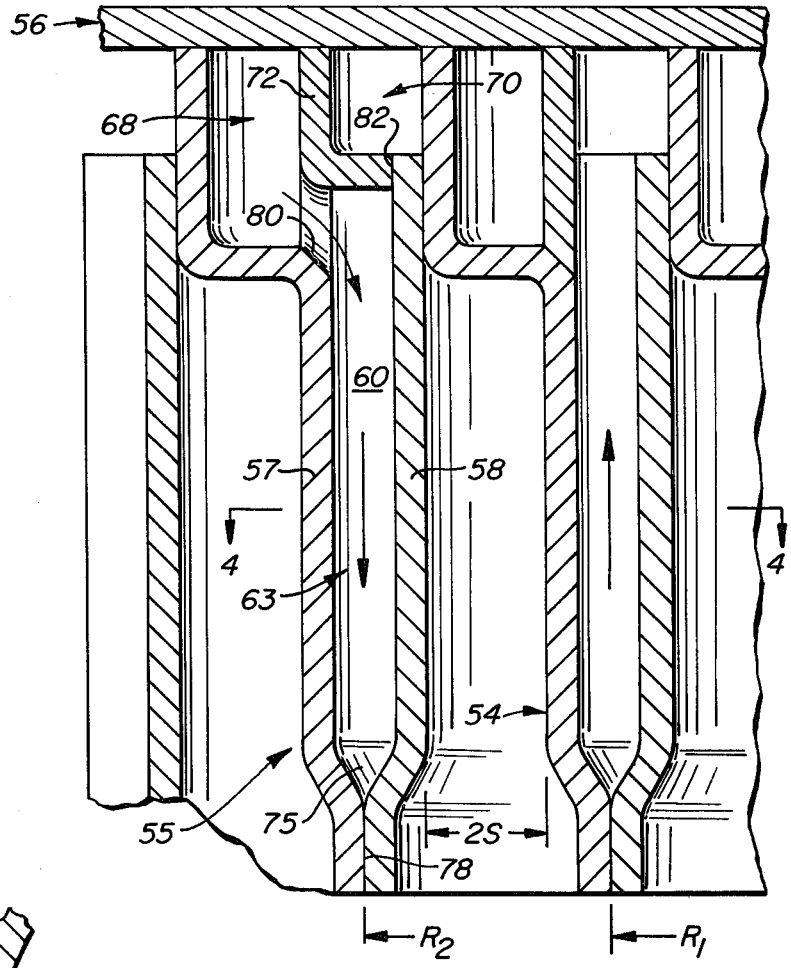
FIG. 3 is a fragmentary sectional elevation view of a preferred construction of a cylinder head having circulating fluid within the rings.
Figure 4:
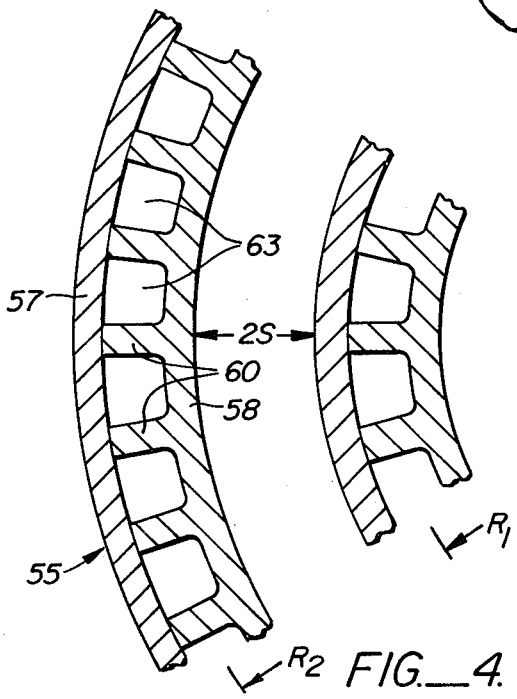
FIG. 4 is a sectional view taken long the line 4—4 of FIG. 3.

A hollow head ring is preferable when the heat that must be transferred in order to maintain an isothermal condition exceeds the amount that may be axially conducted along and/or stored in the rings. FIGS. 3 and 4 illustrate a preferred construction of hollow cylinder head rings through which a heat exchange fluid may be flowed. Two given rings 54 and 55 mounted to a head 56 comprise coaxial cylindrical shells 57 and 58 spaced apart by a plurality of radially and axially extending, generally rectangular spacer segments 50 to define a plurality of axially extending flow channels 63. Head 56 includes two circumferentially extending manifolds 68 and 70 associated with ring 55 for introducing and withdrawing heat exchange fluid into flow channels 63. Manifolds 68 and 70 share a common wall 72. Each flow channel 63 communicates at its end remote from head 56 to a circumferentially adjacent flow channel via a port 75. One of each pair of adjacent communicating flow channels 63 communicates to manifold 68 while the other of the pair communicates to manifold 70. The latter relation is best understood with reference to ring 54. Thus, heat exchange fluid introduced through manifold 68 flows into every second flow channel and is withdrawn through manifold 70 through the remaining flow channels. The heat exchange fluid may be circulated with or without a phase change. A phase change material may be desirable as the heat exchange material to increase the thermal storage or transport capacity of the fluid.

A preferred construction of ring 55 has spacer segments 60 integrally formed on cylindrical shell 58. Shells 57 and 58 come together along a surfce 78 remote from head 56 and are seam welded along surface 78. Common wall 72 meets shells 57 and 58 at surfaces 80 and 82, and is brazed thereto.

The solid head ring embodiment of FIGS. 1 and 2*a* is typically replaced by the hollow ring embodiment of FIGS. 3 and 4 when a greater amount of heat transfer is required to maintain an approximately isothermal condition. In either embodiment, the primary mechanism for heat transfer is conduction from the working fluid to and from the head rings. Working fluid within annular regions 47 condcuts heat to the head rings, while working fluid within annular regions 48 adjacent piston 20 transfers heat to piston rings 35–39 which then conduct the heat to head rings 25–29 across narrow gaps 50. When heat conduction alone does not provide sufficient heat transfer, even with the use of hollow rings, a configuration employing convective heat transfer may be used.

Figure 5:
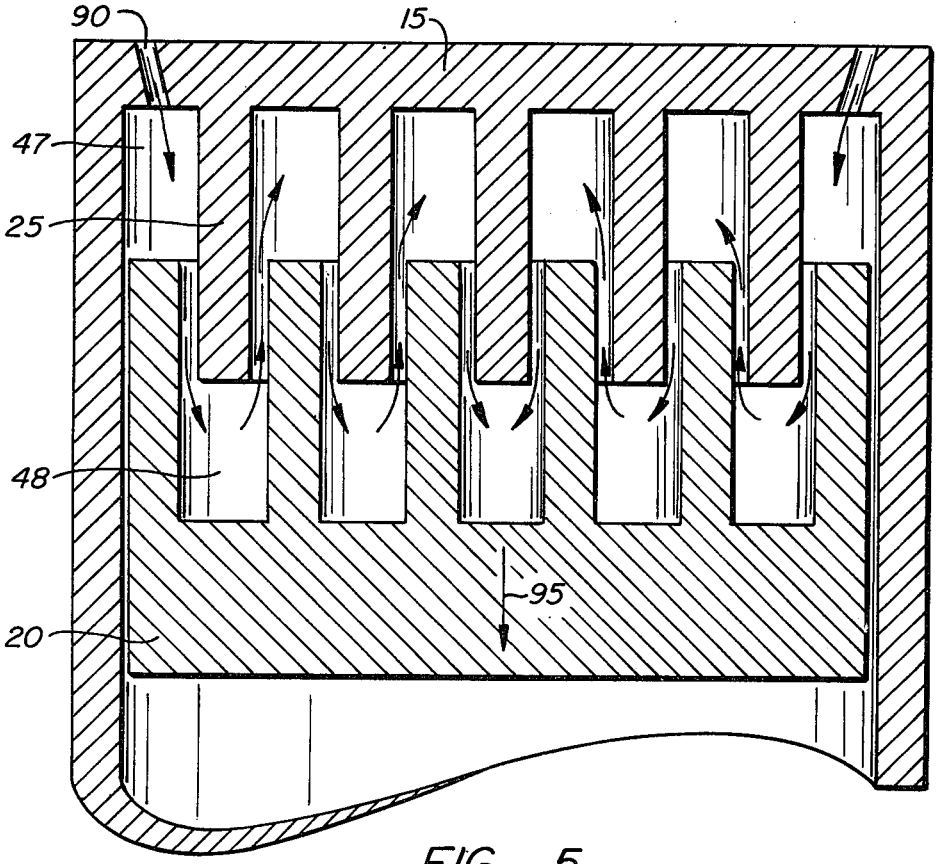
FIG. 5 is a sectional elevation view illustrating the flow path followed by the working fluid in a device having annular ports.

FIG. 5 illustrates schematically an air expander during an expansion portion of its cycle, using the same reference numerals as FIG. 1, where appropriate. Broadly, conductive heat transfer is achieved by causing the working fluid to flow along a tortuous path. Cylinder head 15 has fluid intake ports 90 communicating with radially outermost annular regions 47. As piston 20 moves downward as indicated by arrow 95, fluid enters the radially outermost annular region 47 and flows radially inward along a tortuous path from an annular region 47, through an adjacent gap 50, into an adjacent annular segment 48, and so forth, until the fluid has entered the radially innermost segment. Equivalently, the intake port could be at the center of the cylinder with the fluid flow established in a radially outward direction. Heat transfer occurs convectively as well as conductively as the gas is subjected to a shear force along its path where it contacts ring surfaces.

Figure 6:
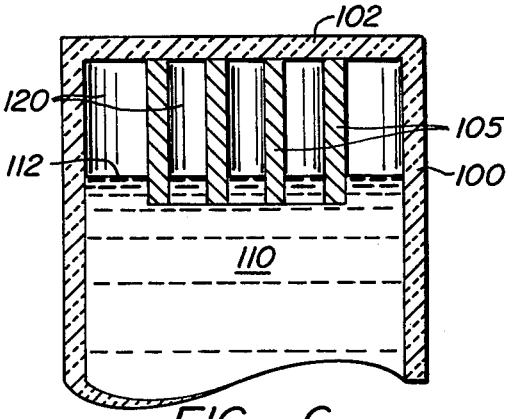
FIG. 6 is a sectional elevation view showing a cylinder head construction of the present invention in conjunction with a liquid piston.
Figure 7:
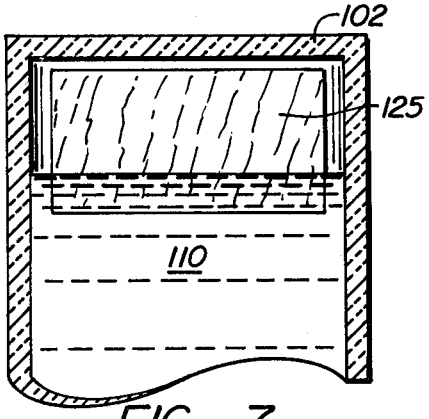
FIG. 7 is a sectional elevation view of a construction of the cylinder head using reticulated materials.
Figure 8:
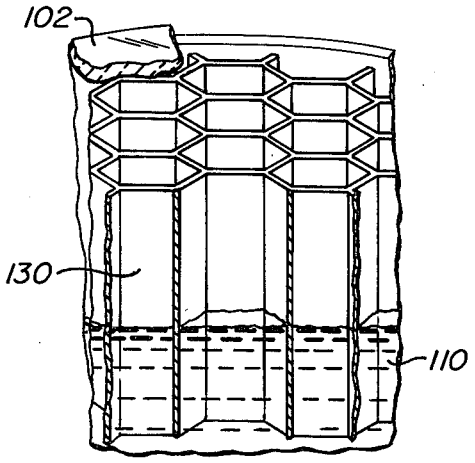
FIG. 8 is a fragmentary perspective view of a cylinder head using a honeycomb core material.

FIGS. 6, 7, and 8, illustrate embodiments wherein a liquid piston is used to provide positive displacement of the working fluid, as for example in a hydraulic accumulator. In FIG. 6, a cylinder 100 is constructed of thermally insulating material. Cylinder 100 has a cylinder head 102 which carries a plurality of thermally conductive concentric rings 105. A volume of liquid 110 has an upper surface 112 that is above the lowermost portions of rings 105, thereby defining a plurality of distinct annular volumes 120 having no fluid flow communication therebetween. Rings 105 are sufficiently massive and have a sufficiently high specific heat that their thermal capacity is large enough to maintain fluid within volumes 120 at substantially the same temperature during vertical excursions of liquid surface 112.

FIG. 7 illustrates an embodiment of a liquid piston isothermalized device wherein the working fluid is contained within microscopic open channels within a rigid reticulated foam stucture 125 of heat conductive material. A method of fabricating a metallic reticulated foam structure is set forth in U.S. Pat. No. 3,946,039. The level of liquid piston 110 remains above the lowermost extent of structure 125 at all times. As the level of liquid piston 110 moves upwardly, it occupies the open channels within the foam structure, decreasing the volume available to the working fluid. Because of the small size of the open channels within the foam structure, a short flow path is provided for heat transferred between the working fluid and the structure. The heat energy can be simply absorbed and returned by the foam structure and/or cycled to a reservoir as discussed with reference to the embodiment of FIG. 1 to isothermalize the working fluid.

FIG. 8 illustrates an embodiment wherein the working fluid is contained within portions of a honeycomb core structure 130 of heat conductive material which extends below level 112 of liquid piston 110. As in the foregoing embodiment, the honeycomb material can act either alone or together with a reservoir to isothermalize the working fluid in the chamber.

Figure 9:
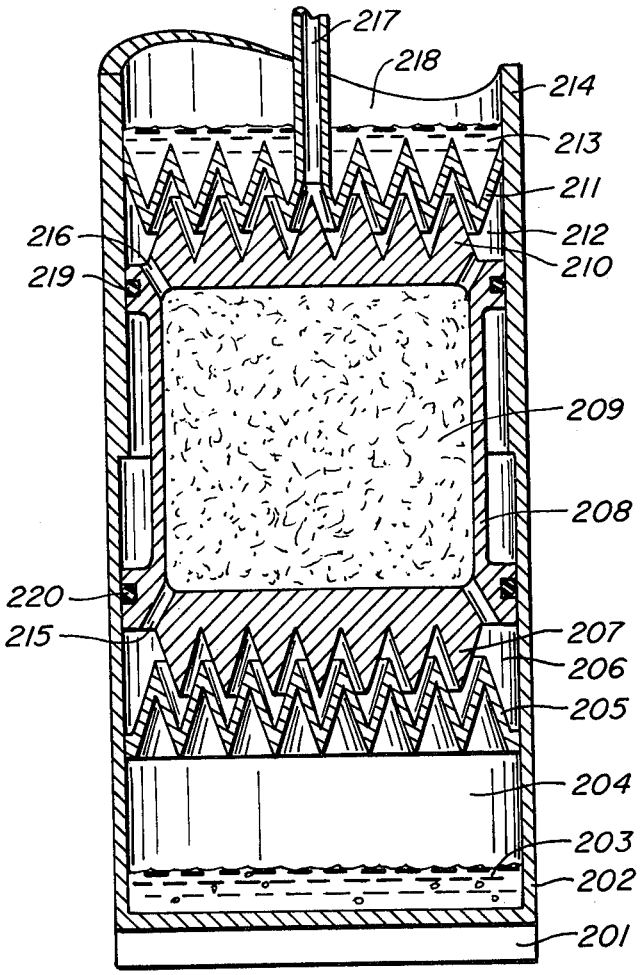
FIG. 9 is a sectional view of a free-displacer for a Stirling-type machine using hollow tapered meshing rings for isothermalizing the working fluid and an internal regenerative matrix in the displacer.

FIG. 9 illustrates an embodiment wherein a source of thermal energy 201 transfers heat to a reflux boiler 202 containing a boiling liquid 203 whose vapor 204 condenses on the underside of concentric tapered rings 205 thereby providing a constant temperature thermal source that is conducted through the hollow thin-walled concentric rings 205 to working fluid 206 contained within chamber formed by rings 205 and nesting concentric solid rings 207 which are integral to reciprocating displacer 208. Displacer 208 contains a regenerative heat exchange matrix 209, comprising stacked screens or a recticulated porous matrix, such as set forth in U.S. Pat. No. 3,946,039. The upper end of displacer 208 comprises concentric solid rings 210. Rings 210 and nesting concentric hollow tapered rings 211 form a chamber containing working fluid 212 which is maintained essentially at the temperature of rings 211 by heat transfer to rings 211, which are cooled by the boiling fluid 213 in reflux boiler 214.

In operation the downward movement of displacer 208 transfers working fluid in chamber volume 206, having the temperature of rings 205, through a tortuous path around rings 205, through circumferentially located axial ports 215 into regenerative heat exchange matrix 209 wherein the temperature is changed to essentially that of rings 211. The working fluid exits through circumferentially located ports 216 into chamber volume 212. Near the completion of the downward stroke working fluid in chamber 212 is compressed by fluid flow through conduit 217. Conduit 217, communicates to a cylinder and piston (not shown) for driving a load in the case of an engine or for receiving a mechanical input in the case of a heat pump. Rings 211 cool the compressing gas in chamber 212 during the compression process by transferring heat through rings 211 to phase change fluid 213 thereby boiling fluid 213 to create vapor 218 which is condensed externally to the displacer cylinder in an external heat exchanger. The increase in pressure of working fluid in chamber volume 212 is communicated through ports 216, regenerator matrix 209 and ports 215 to chamber volume 206 so as to maintain essentially a constant pressure throughout the working fluid volume of displacer 208. This increase in working fluid pressure acts on the differential area of displacer 208 with said differential area formed by sealing rings 220 and 219 wherein the diameter of ring 220 is greater than the diameter of ring 219. As a result of this differential area in increase in working fluid pressure drives displacer 208 upward. This upward stroke transfers working fluid in chamber volume 212 through ports 216, regenerator 209 and ports 215 to chamber 206 in which process the regenerator 209 transfers heat with the working fluid such that fluid exiting ports 215 is essentially at the temperature of rings 205. The fluid is then expanded by transferring fluid through conduit 217. During the expansion the working fluid in chamber 206 is maintained at essentially constant temperature by heat transfer with rings 205 which are heated by condensing vapor 204 on the underside of rings 205, where said vapor is provided by heating liquid 203 boiling in reflux boiler 202 by heat source 201. This working fluid expansion process decreases working fluid pressure in chamber volumes 206, 209 and 212 which in turn generates a downward force on displacer 208 owing to the larger diameter of ring 220 relative to ring 219. This downward force drives displacer 208 downward thereby completing the thermodynamic cyle that the working fluid is subjected to. A more detailed description of the dynamics and operation of free-displacer 208 are presented in U.S. Pat. No. 4,044,558. In the above described cycle rings 205 and 211 are maintained the working fluid contained in respective chamber volumes 206 and 212 at essentially constant temperature thereby insuring that all thermal energy was transferred to and from the working fluid at essentially the respective temperatures of the heat source 201 and the cooled vapor 218 thereby achieving nearly Carnot efficiency for this thermal machine.

Figure 10:
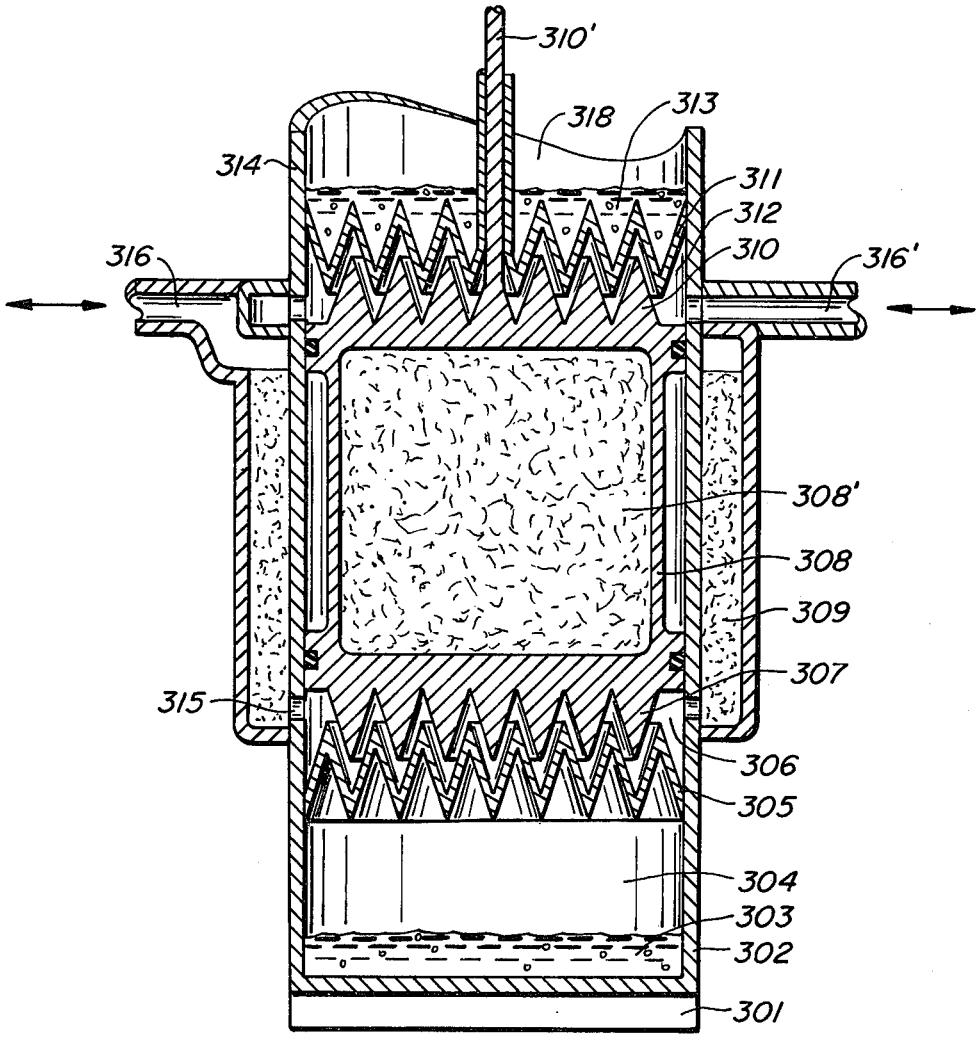
FIG. 10 is a sectional view of a free-piston for a double-acting Siemens (Rinia) version of a Stirling-type machine using hollow tapered meshing rings for isothermalizing the working fluid and an external regenerative matrix.

Another embodiment of this invention is shown in FIG. 10 which shows one of a plurality of equivalent cylinder-and-piston assemblies coupled in a closed loop series. A source of thermal energy 301 transfers heat to a reflux boiler 302 containing a boiling liquid 303 whose vapor 304 condenses on the underside of concentric tapered rings 305 thereby providing a constant temperature thermal source that is conducted through the hollow thin-walled concentric rings 305 to working fluid 306 contained within chamber formed by rings 305 and nesting concentric solid rings 307 which are integral to reciprocating piston 308, which is filled with insulation in cavity 308'. The upper end of piston 308 comprises concentric solid rings 310. Movement of piston 308 is coupled to an external load or mechanical input by a shaft 310. Rings 310 and nesting concentric hollow tapered rings 311 form a chamber containing working fluid 312 which is maintained essentially at the temperature of rings 311 by heat transfer to rings 311, which are cooled by the boiling fluid 313 in reflux boiler 314.

In operation the downward movement of piston 308 transfers working fluid in chamber volume 306, having the temperature of rings 305, through a tortuous path around rings 305, through circumferentially located radial ports 315 into annular regenerator heat exchange matrix 309 wherein the temperature is changed to essentially that of rings 311. The working fluid exits through conduit 316 into an adjacent equivalent cylinder (not shown). Simultaneously, during this downward stroke working fluid enters chamber volume 312 through conduit 316' from an adjacent equivalent cylinder (not shown). Near the completion of this downward stroke working fluid in chamber 312 is compressed by fluid flow through conduit 316'. Rings 311 cool the compressing gas in chamber 311 during the compression process by transferring heat through rings 311 to phase change fluid 313 thereby boiling fluid 313 to create vapor 318 which is condensed externally to the piston cylinder in an external heat exchanger. Piston 308 then is driven upward wherein working fluid in chamber volume 312, having a temperature essentially equal to that of rings 311, is transferred through conduit 316' to the right adjacent cylinder while working fluid at essentially the temperature of rings 311 is transferred through conduit 316, through regenerator matrix 309 and ports 315 to chamber 306 in which process the regenerator 309 transfers heat with the working fluid such that fluid exiting ports 135 is essentially at the temperature of rings 305. The fluid is then expanded by transferring fluid through conduit 316. During this expansion the working fluid in chamber 306 is maintained at essentially constant temperature by heat transfer with rings 305 which are heated by condensing vapor 304 on the underside of rings 305, where said vapor is provided by heating liquid 303 boiling in reflux boiler 302 by heat source 301. Following this expansion process piston 308 is driven downward thereby completing the thermodynamic cycle that the working fluid is subjected to. A more detailed description of the dynamics and operation of free-piston 308 are presented in U.S. Pat. No. 4,044,558. In the above described cycle rings 305 and 311 maintained the working fluid contained in respective chamber volumes 306 and 312 at essentially constant temperature thereby insuring that all thermal energy was transferred to and from the working fluid at essentially the respective temperatures of the heat source 301 and the cooled vapor 318 thereby achieving nearly Carnot efficiency for this thermal machine.

Figure 11:
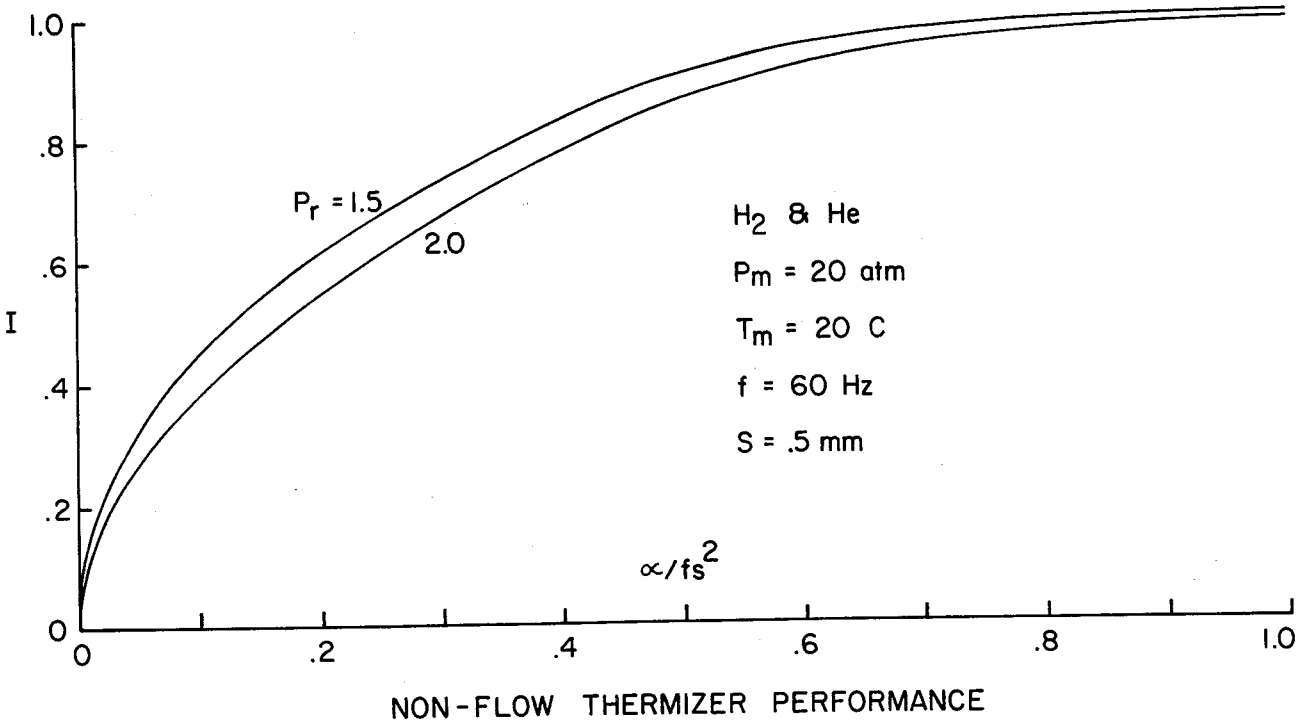
FIG. 11 is a graph which presents experimental results for nesting concentric ring type isothermalizers.

The extent of isothermalization produced by this invention is shown, for example, in FIG. 11 which represents experimental data obtained for concentric nesting rings in a reciprocating variable volume chamber for two pressure ratios ($P_r$). The abscissa is the dimensionless Fourier number comprising thermal diffusivity ($\alpha$), frequency of reciprocation (f) and half-width ring spacing (s) while the ordinate is the dimensionless isothermalization factor I defined as the ratio of heat transferred to the isothermalizers in the non-flow process experimentally measured to that heat transferred in a non-flow isothermal process ($I=1$ for an isothermal process; $I=0$ for an adiabatic process). The necessity of using closely spaced thin rings for isothermalizing is evident.

While several embodiments of the present invention have been illustrated hereinabove, it is apparent that all of those embodiments share certain specific characteristics. Each of the embodiments employ a fixed, rigid heat conductive element. The heat conductive element has a surface area which is large relative to the surface area of the chamber, and short flow paths are provided for heat conduction between any portion of the working fluid and the heat conductive element. The volume of the chamber is varied by a piston, either solid or liquid, which meshes with the heat conductive element. When the volume of the chamber is at its minimum, an absolute minimum of dead volume remains. As the volumes or pressure of the chamber varies, heat is transferred to and from the heat conductive element to maintain the working fluid at substantially constant temperature.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims:

What is claimed is:

1. An isothermalizer system comprising:

a chamber having a heat source end and a heat sink end and a heat source having a substantially constant temperature from cycle to cycle at said heat source end;

a pair of thermally conductive walls comprising concentric tapered rings to increase their surface area spanning the chamber and forming a heat source subchamber at the heat source end of the chamber, a heat sink subchamber at the heat sink end of the chamber, and a central subchamber between the respective thermally conductive walls;

a piston located in the central subchamber and reciprocal between the respective thermally conductive walls, said piston having complementary tapered ridges which mesh with the rings of the thermally conductive walls;

a heat source fluid in the heat source subchamber to maintain the thermally conductive wall proximate the heat source end of the chamber at substantially the temperature of the heat source;

a heat sink fluid in the heat sink subchamber having a temperature different from that of the heat source to maintain the thermally conductive wall proximate the heat sink end of the chamber at a substantially constant temperature different from that of the heat source;

a working fluid located between the respective walls and the piston, the working fluid adjacent the wall proximate the heat source end of the chamber having a temperature substantially equal to that of the heat source and the working fluid adjacent the wall proximate the heat sink end of the chamber having a temperature substantially equal to the temperature of the heat sink fluid;

heat regenerative material; and means for cycling the working fluid to and from the opposite sides of the piston within the chamber through the regenerative material, said working fluid undergoing a thermodynamic cycle which achieves nearly Carnot efficiency.

2. A system as recited in claim 1 and additionally comprising a conduit penetrating the thermally conductive wall proximate the heat sink end of the chamber and connected to a pressure actuated load.

3. A system as recited in claim 1 wherein the piston is hollow and has ports in the faces confronting the thermally conductive walls, and in which the regenerative material is located within the piston, the working fluid being cycled through the piston and the regenerative material located therein.

4. A system as recited in claim 1 wherein the chamber has a larger cross sectional area toward the heat source end than toward the heat sink end, and in which the piston has a differential area so that the face confronting the thermally conductive wall proximate the heat source end is larger than that confronting the thermally conductive wall proximate the heat sink end, whereby an equal pressure in the working fluid results in a net force on the piston toward the heat sink end of the chamber.

5. A system as recited in claim 1 wherein the piston contains heat insulative material, and in which the faces of the piston confronting the thermally conductive walls are impenetrable by the working fluid.

6. A system as recited in claim 1 in which the piston is mechanically coupled to an external force.

7. A system as recited in claim 1 and comprising plural chambers and associated elements, additionally comprising conduits interconnecting the respective chamber so that working fluid is cycled between the heat source end of one chamber and the heat sink end of another chamber, and wherein the regenerative material is located within the conduits.

8. An isothermalizing element comprising:

a chamber;

a pair of thermally conductive walls each comprising a plurality of concentric tapered rings of thermally conductive material, said walls dividing the chamber into a pair of thermally controlled subchambers and a working subchamber;

a pair of temperature control fluids in the respective thermally controlled subchambers which maintain the temperatures in said thermally controlled subchambers substantially constant, the temperatures of the respective subchambers being different;

a piston reciprocal in the working subchamber toward and away from the thermally conductive walls, the faces of the piston confronting the walls having complementary concentric ridges for nesting with the concentric tapered rings of the thermally conductive walls to minimize dead volume therebetween; and a pair of working fluids between the piston and the respective thermally conductive walls in the working subchamber which undergo a thermodynamic cycle.

9. The isothermalizing element of claim 8 wherein the temperature control fluid comprises a phase change material including liquid and vapor.

10. The isothermalizing element of claim 8 wherein the thermally conductive wall is constructed of metal having a substantially constant thickness.

11. The isothermalizer element of claim 8 wherein the first and second working fluids are the same and are cycled between the respective sides of the piston.

12. The isothermalizing element of claim 11 in which the piston is hollow, and the faces confronting the respective thermally conductive walls have ports communicating with the hollow center, so that the working fluid cycles through the interior of the piston.

13. The isothermalizing element of claim 8 wherein the piston is solid.

14. The isothermalizing element of claim 8 wherein the thermally conductive wall includes a conduit penetrating the wall to the working subchamber.

15. The isothermalizing element of claim 14 wherein the working fluid passes through the conduit to a pressure actuated load.

16. The isothermalizing element of claim 14 and additionally comprising a shaft emanating from the piston and passing through the conduit, said shaft being mechanically coupled to an external force.

17. An isothermalizer system comprising:

a chamber having a heat source end and a heat sink end and a heat source having a substantially constant from cycle to cycle at said heat source end, said chamber having a larger cross-sectional area toward the heat source end than toward the heat sink end;

a pair of thermally conductive walls spanning the chamber and forming a heat source subchamber at the heat source end of the chamber, a heat sink subchamber at the heat sink end of the chamber, and a central subchamber between the respective thermally conductive walls, said walls comprising concentric tapered rings to increase their surface area, the thermally conductive wall proximate the heat sink end of the chamber including a conduit to a pressure actuated load;

a piston located in the central subchamber and reciprocal between the respective thermally conductive walls, the piston having complementary concentric ridges which meet with the rings of the respective walls, said piston having a hollow center and ports penetrating the faces confronting the respective thermally conductive walls, said piston further having a differential area so that the face confronting the thermally conductive wall proximate the heat source end is larger than that confronting the thermally conductive wall proximate the heat sink end;

a heat source fluid in the heat source subchamber to maintain the thermally conductive wall proximate the heat source end of the chamber at substantially the temperature of the heat source;

a heat sink fluid in the heat sink subchamber having a temperature different from that of the heat source to maintain the thermally conductive wall proximate the heat sink end of the chamber at a substantially constant temperature different from that of the heat source;

a working fluid located between the respective walls of the piston and filling the hollow center thereof, the working fluid adjacent the wall proximate the heat source end of the chamber having a temperature substantially equal to that of the heat source and the working fluid adjacent the wall proximate the heat sink end of the chamber having a temperature substantially equal to that of the temperature of the heat sink fluid, said working fluid undergoing a thermodynamic cycle which achieves nearly Carnot efficiency.

18. A system as recited in claim 1 or 17 wherein the chamber has upper and lower ends, the heat source end being the lower end and the heat sink end being the upper end.

19. An isothermalizer system comprising:

a plurality of chambers each having a heat source end and a heat sink end and a heat source having a substantially constant temperature from cycle to cycle at said heat source end, a pair of thermally conductive walls spanning the chamber and forming a heat source subchamber at the heat source end of the chamber, a heat sink subchamber at the heat sink end of the chamber, and a central subchamber between the thermally conductive walls, said walls comprising concentric tapered rings to increase their surface area, a piston located in the central subchamber and reciprocal between the respective thermally conductive walls and having complementary concentric tapered ridges which mesh with the rings, a heat source fluid in the heat source subchamber to maintain the thermally conductive wall proximate the heat source end of the chamber at substantially the temperature of the heat source, and a heat sink fluid in the heat sink subchamber having a temperature different from that of the heat source to maintain the thermally conductive wall proximate the heat sink end of the chamber at a substantially constant temperature different from that of the heat source;

means for mechanically coupling the piston to an external force;

conduits connecting each space between the piston and the thermally conductive wall proximate the heat source end of one chamber with the space between the piston and the thermally conductive wall proximate the heat sink end of another subchamber, said conduits including heat regenerative material, so that the working fluid is cycled to and from the opposite sides of the pistons in joined chambers through the regenerative material, said working fluid undergoing a thermodynamic cycle which achieves near Carnot efficiency.

20. A system as recited in claim 1, 17 or 19 wherein the thermally conductive walls comprise concentric tapered rings to increase the surface area of the walls, and wherein the piston has complementary concentric tapered ridges which nest with the rings.

21. A system as recited in claims 1, 17 or 19 wherein the heat sink fluid includes liquid and vapor, and in which the temperature of the heat sink fluid comprises its boiling temperature.

22. A system as recited in claim 1, 17 or 19 in which the heat source fluid includes liquid and vapor.

23. A system as recited in claim 1, 17 or 19 in which the temperature of the heat sink fluid is below that of the heat source fluid.

24. An isothermalizer system comprising:

a chamber having a heat source end and a heat sink end and a heat source having a substantially constant temperature from cycle to cycle at said heat source end;

a pair of thermally conductive walls spanning the chamber and forming a heat source subchamber at the heat source end of the chamber, a heat sink subchamber at the heat sink end of the chamber, and a central subchamber between the respective thermally conductive walls;

a piston located in the central subchamber and reciprocal between the respective thermally conductive walls;

a heat source fluid in the heat source subchamber to maintain the thermally conductive wall proximate the heat source end of the chamber at substantially the temperature of the heat source;

a heat sink fluid including liquid and vapor in the heat sink subchamber having a boiling temperature different from the temperature of the heat source to maintain the thermally conductive wall proximate the heat sink end of the chamber at a substantially constant temperature different from that of the heat source;

a working fluid located between the respective walls and the piston, the working fluid adjacent the wall proximate the heat source end of the chamber having a temperature substantially equal to that of the heat source and the working fluid adjacent the wall proximate the heat sink end of the chamber having a temperature substantially equal to the temperature of the heat sink fluid;

heat regenerative material; and means for cycling the working fluid to and from the opposite sides of the piston within the chamber through the regenerative material, said working fluid undergoing a thermodynamic cycle which achieves nearly Carnot efficiency.

25. An isothermalizer system comprising:

a chamber having a heat source end and a heat sink end and a heat source having a substantially constant temperature from cycle to cycle at said source end, said chamber having a larger cross-sectional area toward the heat source end than toward the heat sink end;

a pair of thermally conductive walls spanning the chamber and forming a heat source subchamber at the heat source end of the chamber, a heat sink subchamber at the heat sink end of the chamber, and a central subchamber between the respective thermally conductive walls, the thermally conductive wall proximate the heat sink end of the chamber including a conduit to a pressure actuated load;

a piston located in the central subchamber and reciprocal between the respective thermally conductive walls, said piston having a hollow center and ports penetrating the faces confronting the respective thermally conductive walls, said piston further having a differential area so that the face confronting the thermally conductive wall proximate the heat source end is larger than that confronting the thermally conductive wall proximate the heat sink end;

a heat source fluid in the heat source subchamber to maintain the thermally conductive wall proximate the heat source end of the chamber at substantially the temperature of the heat source;

a heat sink fluid including liquid and vapor in the heat sink subchamber having a boiling temperature different from the temperature of the heat source to maintain the thermally conductive wall proximate the heat sink end of the chamber at a substantially constant temperature different from that of the heat source;

a working fluid located between the respective walls of the piston and filling the hollow center thereof, the working fluid adjacent the wall proximate the heat source end of the chamber having a temperature substantially equal to that of the heat source and the working fluid adjacent the wall proximate the heat sink end of the chamber having a temperature substantially equal to that of the temperature of the heat sink fluid, said working fluid undergoing a thermodynamic cycle which achieves nearly Carnot efficiency.

26. An isothermalizer system comprising:

a plurality of chambers each having a heat source end and a heat sink end and a heat source having a substantially constant temperature from cycle to cycle at said heat source end, a pair of thermally conductive walls spanning the chamber and forming a heat source subchamber at the heat source end of the chamber, a heat sink subchamber at the heat sink end of the chamber, and a central subchamber between the thermally conductive walls, a piston located in the central subchamber and reciprocal between the respective thermally conductive walls, a heat source fluid in the heat source subchamber to maintain the thermally conductive wall proximate the heat source end of the chamber at substantially the temperature of the heat souce, and a heat sink fluid including liquid and vapor in the heat sink subchamber having a boiling temperature different from the temperature of the heat source to maintain the thermally conductive wall proximate the heat sink end of the chamber at a substantially constant temperature different from that of the heat source;

means for mechanically coupling the piston to an external force;

conduits connecting each space between the piston and the thermally conductive wall proximate that heat source end of one chamber with the space between the piston and the thermally conductive wall proximate the heat end of another subchamber, said conduits including heat regenerative material, so that the working fluid is cycled to and from the opposite sides of the pistons in joined chambers through the regenerative material, said working fluid undergoing a thermodynamic cycle which achieves near Carnot efficiency.

27. An isothermalizer system comprising:

a chamber having a heat source end and a heat sink end and a heat source having a substantially constant temperature from cycle to cycle at said heat source end;

a pair of thermally conductive walls spanning the chamber and forming a heat source subchamber at the heat source end of the chamber, a heat sink subchamber at the heat sink end of the chamber, and a central subchamber between the respective thermally conductive walls;

a piston located in the central subchamber and reciprocal between the respective thermally conductive walls;

a heat source fluid including liquid and vapor in the heat source subchamber to maintain the thermally conductive wall proximate the heat source end of the chamber at substantially the temperature of the heat source;

a heat sink fluid in the heat sink subchamber having a temperature different from that of the heat source to maintain the thermally conductive wall proximate the heat sink end of the chamber at a substantially constant temperature different from that of the heat source;

a working fluid located between the respective walls and the piston, the working fluid adjacent the wall proximate the heat source end of the chamber having a temperature substantially equal to that of the heat source and the working fluid adjacent the wall proximate the heat sink end of the chamber having a temperature substantially equal to the temperature of the heat sink fluid;

heat regenerative material; and means for cycling the working fluid to and from the opposite sides of the piston within the chamber through the regenerative material, said working fluid undergoing a thermodynamic cycle which achieves nearly Carnot efficiency.

28. An isothermalizer system comprising:

a chamber having a heat source end and a heat sink end and a heat source having a substantially constant temperature from cycle to cycle at said heat source end, said chamber having a larger cross-sectional area toward the heat source end than toward the heat sink end;

a pair of thermally conductive walls spanning the chamber and forming a heat source subchamber at the heat source end of the chamber, a heat sink subchamber at the heat sink end of the chamber, and a central subchamber between the respective thermally conductive walls, the thermally conductive wall proximate the heat sink end of the chamber including a conduit to a pressure actuated load;

a piston located in the central subchamber and reciprocal between the respective thermally conductive walls, said piston having a hollow center and ports penetrating the faces confronting the respective thermally conductive walls, said piston further having a differential area so that the face confronting the thermally conductive wall proximate the heat source end is larger than that confronting the thermally conductive wall proximate the heat sink end;

a heat source fluid in the heat source subchamber to maintain the thermally conductive wall proximate the heat source end of the chamber at substantially the temperature of the heat source;

a heat sink fluid in the heat sink subchamber having a temperature different from that of the heat source to maintain the thermally conductive wall proximate the heat sink end of the chamber at a substantially constant temperature different from that of the heat source;

a working fluid located between the respective walls of the piston and filling the hollow center thereof, the working fluid adjacent the wall proximate the heat source end of the chamber having a temperature substantially equal to that of the heat source and the working fluid adjacent the wall proximate the heat sink end of the chamber having a temperature substantially equal to that of the temperature of the heat sink fluid, said working fluid undergoing a thermodynamic cycle which achieves nearly Carnot efficiency.

29. An isothermalizer system comprising:

a plurality of chambers each having a heat source end and a heat sink end and a heat source having a substantially constant temperature from cycle to cycle at said heat source end, a pair of thermally conductive walls spanning the chamber and forming a heat source subchamber at the heat source end of the chamber, a heat sink subchamber at the heat sink end of the chamber, and a central subchamber between the thermally conductive walls, a piston located in the central subchamber and reciprocal between the respective thermally conductive walls, a heat source fluid including liquid and vapor in the heat source subchamber to maintain the thermally conductive wall proximate the heat source end of the chamber at substantially the temperature of the heat source, and a heat sink fluid in the heat sink subchamber having a temperature different from that of the heat source to maintain the thermally conductive wall proximate the heat sink end of the chamber at a substantially constant temperature different from that of the heat source;

means for mechanically coupling the piston to an external force;

conduits connecting each space between the piston and the thermally conductive wall proximate the heat souce end of one chamber with the space between the piston and the thermally conductive wall proximate the heat sink end of another subchamber, said conduits including heat regenerative material, so that the working fluid is cycled to and from the opposite sides of the pistons in joined chambers through the regenerative material, said working fluid undergoing a thermodynamic cycle which achieves near Carnot efficiency.

* * * * *